US011319136B2

(12) United States Patent
Buzot et al.

(10) Patent No.: US 11,319,136 B2
(45) Date of Patent: May 3, 2022

(54) PACKAGING FOR SPRAYABLE PERFUME PRODUCTS

(71) Applicant: ELC Management LLC, Melville, NY (US)

(72) Inventors: Herve Georges Buzot, Mendham, NJ (US); Lemis Tarajano Noya, Miami, FL (US)

(73) Assignee: ELC Management LLC, Melville, NY (US)

( * ) Notice: Subject to any disclaimer, the term of this patent is extended or adjusted under 35 U.S.C. 154(b) by 167 days.

(21) Appl. No.: 16/903,846

(22) Filed: Jun. 17, 2020

(65) Prior Publication Data

US 2021/0394991 A1 Dec. 23, 2021

(51) Int. Cl.
*B65D 81/36* (2006.01)
*A45D 34/02* (2006.01)
*B65D 77/04* (2006.01)

(52) U.S. Cl.
CPC ..... *B65D 81/36* (2013.01); *A45D 34/02* (2013.01); *B65D 77/0426* (2013.01); *A45D 2200/056* (2013.01)

(58) Field of Classification Search
CPC ..... B65D 81/36; B65D 77/0426; B65D 2203/00; B65D 5/4212; B65D 2203/12; B65D 2203/04; A45D 34/00; A45D 34/02; A45D 34/06; A45D 40/0068; A45D 40/0075
USPC ..... 206/581, 459.1, 459.5, 457
See application file for complete search history.

(56) References Cited

U.S. PATENT DOCUMENTS 7,621,402 B2 * 11/2009 Sandow ..... B65D 5/52 206/581
2002/0108883 A1 * 8/2002 Levin ..... A45C 11/182 206/581
2004/0188461 A1 * 9/2004 Pennaneac'h ..... B65D 83/00 222/153.07
2005/0048243 A1 * 3/2005 Brown ..... A45D 40/0087 428/40.1
2005/0061710 A1 * 3/2005 Dobler ..... A61L 9/12 206/730
2005/0276937 A1 * 12/2005 Kosth ..... B65D 1/265 428/34.1
2006/0042992 A1 * 3/2006 Vulcano ..... A46B 15/0091 206/581
2006/0175226 A1 * 8/2006 Abergel ..... B65D 79/00 206/568

(Continued)

FOREIGN PATENT DOCUMENTS

EP 2720878 B1 12/2016

OTHER PUBLICATIONS

PCT International Search Report; International Application No. PCT/US2021/037523; Completion Date: Oct. 8, 2021; dated Oct. 8, 2021; 20.38.

(Continued)

*Primary Examiner* — Rafael A Ortiz
(74) *Attorney, Agent, or Firm* — Peter Giancana

(57) ABSTRACT

A combination of primary and secondary packages wherein the primary package contains a sprayable, alcohol-based perfume product, and the secondary package contains the primary package, and comprises at least one surface that is printed with a hydrochromic ink, and that is able to quickly absorb, but slowly release, the alcohol-based perfume product.

5 Claims, 4 Drawing Sheets

(56) References Cited

U.S. PATENT DOCUMENTS

| | | | | |
|---|---|---|---|---|
| 2007/0007164 | A1* | 1/2007 | Lord | A61J 7/0084 206/581 |
| 2007/0227934 | A1* | 10/2007 | Fracassi | A45D 31/00 206/581 |
| 2008/0302699 | A1* | 12/2008 | Berg | B65D 83/04 206/581 |
| 2019/0014882 | A1* | 1/2019 | Bedel | B05B 1/02 |
| 2020/0048589 | A1 | 2/2020 | Cooke et al. | |

OTHER PUBLICATIONS

PCT Written Opinion of the International Searching Authority; International Application No. PCT/US2021/037523; Completion Date: Oct. 8, 2021; dated Oct. 8, 2021; 20.38.

* cited by examiner

PACKAGING FOR SPRAYABLE PERFUME PRODUCTS

FIELD OF THE INVENTION

The invention is in the field of packaging for perfume products. More specifically, the invention concerns primary and secondary packaging for sprayable, alcohol-based perfume products.

BACKGROUND OF THE INVENTION

The layer of packaging that comes into direct contact with a product is called primary packaging. For example, for a sprayable perfume product, the primary packaging will usually comprise a glass bottle, and a mechanical spray pump that comprises plastic and metal parts. For this type of product, paper-based components are not generally used in the primary packaging.

In contrast, secondary packaging is the layer of packaging that surrounds and protects the primary packaging. In the consumer goods market, most secondary packaging is some form of paper-based construction, such as paperboard cartons, corrugated fiberboard inserts, tissue paper for decoration and fill, and wrapping paper. Among the many functions of paper-based secondary packaging are physical protection (i.e. from shock, vibration and temperature); barrier protection (i.e. from dust and light); information display (i.e. how to use and dispose); marketing and branding (i.e. using graphics to convey a brand message); and security (i.e. tamper-evident and anti-counterfeiting features). Usually, all of these functions are exhausted once the secondary packaging is opened, or shortly thereafter. In fact, when a consumer has purchased a product, and is ready to use it, the consumer usually discards all or most of the secondary packaging. For example, if the product is a perfume in a glass bottle with a spray pump, the consumer usually discards the paperboard carton, any corrugated fiberboard inserts, any tissue paper or wrapping paper, etc. This is because most paper-based secondary packaging has no usefulness after the package is opened.

Paperboard is a relatively thick (usually over 0.30 mm) paper-based material that is rigid, but also foldable without breaking or tearing. Grammage, the mass of paperboard per unit area, is expressed in grams per square meter ($g/m^2$). The International Organization for Standardization (ISO) defines paperboard as paper with a grammage above 250 $g/m^2$. When the thickness (or caliper) of a sheet of paperboard is known (generally by direct measurement), then the density of the material may be computed as grammage divided by caliper. Furthermore, the density of a given paperboard is a direct indication of the porosity and absorbency of the material, where a lower density generally indicates greater porosity and absorbency. The porosity and absorbency are not generally a concern when designing secondary packaging for sprayable cosmetic products, such as a perfume. However, they are important in the present invention.

OBJECTS OF THE INVENTION

A main object of the invention is to provide primary and secondary packaging for sprayable, alcohol-based perfume products Another object of the invention is to provide secondary packaging that is designed to be sprayed with an alcohol-based perfume product, to offer well defined, significant uses to the consumer.

SUMMARY OF THE INVENTION

The objectives of the invention are met by a combination of an alcohol-based perfume product in a primary package, and a secondary package that comprises at least one surface that has an absorbency, grammage, porosity and thickness as defined herein, and that is printed with a reveal ink. Such a surface is able to quickly absorb some of the alcohol-based liquid product, and then slowly release the volatile components of the product in a controlled fashion. When such a surface is sprayed with an alcohol-based liquid product, the reveal ink becomes visible, and the alcohol-based liquid product slowly diffuses from the surface. In this way, the at least one surface simultaneously provides a persisting visual and olfactory experience.

DESCRIPTIONS OF THE FIGURES

DETAILED SPECIFICATION

Figure 1A:
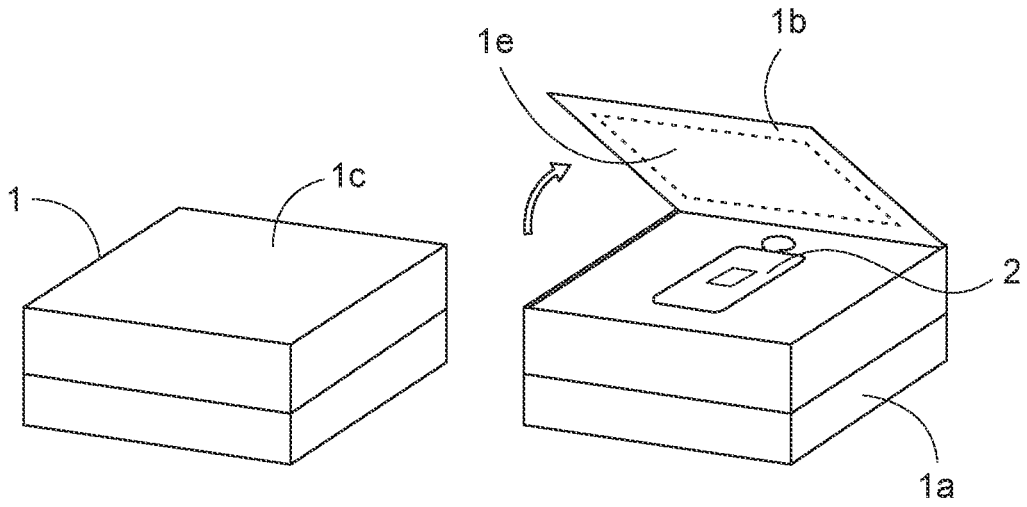
FIG. 1A depicts a first embodiment of a combination of primary and secondary packaging, wherein the secondary package has a surface that has been printed with a base graphic and over-printed with a hydrochromic ink.

As noted above, in the consumer goods market, most secondary packaging is some form of paper-based construction, such as a paperboard carton, corrugated fiberboard inserts, tissue paper for decoration and fill, and wrapping paper. The present invention calls for at least one portion of secondary packaging that is selected based on its ability to quickly absorb an alcohol based product, and then slowly release its volatile compounds. In use, this portion of secondary packaging will be wetted by an alcohol based product, such as by spraying a perfume onto the surface. As a practical restriction, the at least one portion of secondary packaging should be able to completely absorb the alcohol-based product almost immediately, so that the product does not pool on the surface or drip down the surface. In this regard, we screened for potentially useful materials by measuring the time that it takes for a 1 ml drop of water to be completely absorbed into the surface of the material. The drop of water is completely absorbed into the material when there is no pooled water sitting on the surface of the material that could otherwise flow over the surface. In use, a single dose of a typical perfume spray pump is much less than 1 mL (i.e. from about 0.07 mL to about 0.2 mL), and spread over a much larger area than a single drop. Nevertheless, we determined that potentially useful materials include those that are able to completely absorb a 1 mL drop of water in less than thirty seconds.

Of course, how quickly those materials release fragrance into the ambient environment is also important. So, we sought a balance between fast absorption of liquid (so that the sprayed on fragrance will not pool and run on the treated surface) and slow, steady release expected of a perfume diffuser. Many paper-based materials absorb liquid fast, but then release too fast to act as good diffusers. This is demonstrated in the following table. The first entry in the following table is common 20# bond printer paper, the next three are paperboard. While the printer paper absorbed a 1 mL drop of water very quickly, the fragrance also deteriorated quickly. The two paperboards with the higher grammage (490 g/m$^2$ and 630 g/m$^2$) performed best, while the paperboard of grammage 390 g/m$^2$ performed only minimally well.

| Grammage (g/m$^2$) | Typical thickness (mm) for a given grammage of paper type | Absorption time (sec) of 1 mL drop of water | How perfume releases from paper surface |
|---|---|---|---|
| 75 | 0.097 | 5 | weak after 12 hours |
| 390 | 0.889 | 12 | weak after 24 hours |
| 490 | 1.143 | 12 | strong after 24 hours |
| 630 | 1.549 | 16 | stronger after 24 hours |

Another important factor is a material's porosity. Porosity is that fraction of a material's volume that is empty space that is accessible to the absorbed liquid. If the volume could not be filled by the liquid, then we do not count that in the porosity. Generally, if the porosity is too low, then the paper board may not absorb liquid fast enough to be useful in the applications described herein. We have noticed that paperboard that has a porosity of at least 8% is useful in the present invention. On the other hand, relatively thin paper absorbs comparatively little liquid, regardless of porosity. Therefore, in the present invention, the minimum thickness of the at least one portion of secondary packaging is about 0.900 mm.

The absorbency of paper-based materials would, in general, also be affected by any surface treatment. For example, the surfaces of paper-based packaging are sometimes treated to specifically render them less absorbent. Obviously, this, and any other type of surface treatment that would render the packaging insufficiently absorbent, or prevent volatilization from its surface, should be avoided in the present invention. For example, glossy film coatings should be avoided on that portion of paper-board that will be used in the present invention.

Hydrochromic inks comprise molecules of dye that have polar functional groups. When a polar solvent, such as water comes into contact with a hydrochromic ink, the molecules of dye dissolve and disperse, thus lowering the opacity of the ink. When the ink has been applied to a surface as a thin film, contact with the polar solvent will render it transparent. One use for hydrochromic inks is to print a thin film over a graphic image. When dry, the hydrochromic film is opaque and will obscure the underlying or base graphic. This may be accomplished by over-printing a continuous film of hydrochromic ink that is large enough to completely cover the base graphic, or by printing one or more hydrochromic inks in a pattern that obscure, but do not completely cover, the base graphic. Printing the one or more hydrochromic inks on paper-based packaging may be done by silk screen methods. Alternatively, a sheet of hydrochromic film may be over-laid on the graphic image. These sheets are commercially available, and have a clear adhesive backing for applying to a surface, such as to a surface of secondary packaging. When dry, the sheets are opaque, and will hide a base graphic. When wet with water or alcohol-based liquid, the sheet becomes transparent, and the base graphic is revealed. There is no limitation on what the base graphic may depict. While water is commonly used to render the hydrochromic film transparent, alcohol or an alcohol-based liquid, such as perfume, may also be used.

The present invention includes a combination of primary and secondary packages wherein the primary package contains a sprayable, alcohol-based perfume, and the secondary package houses the primary package, and has one or more surfaces that that have the absorbency, grammage, porosity and thickness as defined above, and that bear a base graphic image that has been over-printed with one or more hydrochromic inks or over-laid with a hydrochromic film. Examples of this are shown in FIGS. 1-3.

Figure 1B:
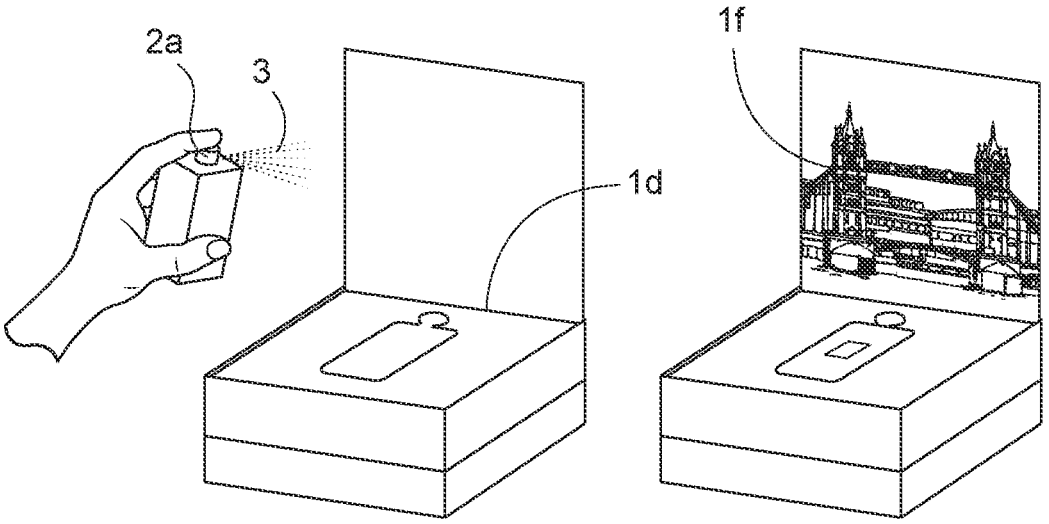
FIG. 1B depicts the secondary packaging of FIG. 1A after the surface has been sprayed with an alcohol-based liquid product that renders the hydrochromic ink transparent, to reveal the hidden graphic.

FIGS. 1A and 1B depict a first embodiment of a combination of primary and secondary packaging according to the present invention. In this case, the primary package comprises a container (2), such as a glass or plastic bottle, and a spray pump (2*a*), while the secondary package is a paper-based carton (1). Referring to FIG. 1A, the carton (1) comprises a bottom (1*a*). The bottom of the carton is adapted to house the container (2), which contains an alcohol-based liquid product (3), such as perfume. The carton comprises at least one surface that has been printed with a base graphic, and then over-printed, or otherwise covered, with a thin film of hydrochromic ink. In this embodiment, the printed surface is the underside (1*b*) of a lid (1*c*) that folds up along a living hinge (1*d*), and remains in an upright position unless moved. In FIG. 1A, the hydrochromic ink (1*e*) is dry and therefore opaque, in this case white. The film of hydrochromic ink is indicated by the dashed line in FIG. 1A.

In FIG. 1B, the container (2) of alcohol-based liquid product (3) has been removed from the bottom (1*a*) of the carton (1). The spray pump (2*a*) is able to dispense the alcohol-based liquid product in the form of an aerosolized mist. After the printed surface (1*b*) has been sprayed with the alcohol-based liquid product. The product renders the hydrochromic film transparent, to reveal the hidden base graphic (1*f*). Thus, the printed surface (1*b*) provides a unique visual experience. Furthermore, the printed surface, as long as it remains exposed to the ambient environment, acts as an aroma diffuser, slowly, but steadily releasing perfume into the air. As the volatile perfume components evaporate from the printed surface (1*b*), the visual and olfactory effects diminish simultaneously. When the hydrochromic film returns to a opaque state, the aroma is also effectively gone. The process may be repeated for the life of the container of perfume.

Figure 2A:
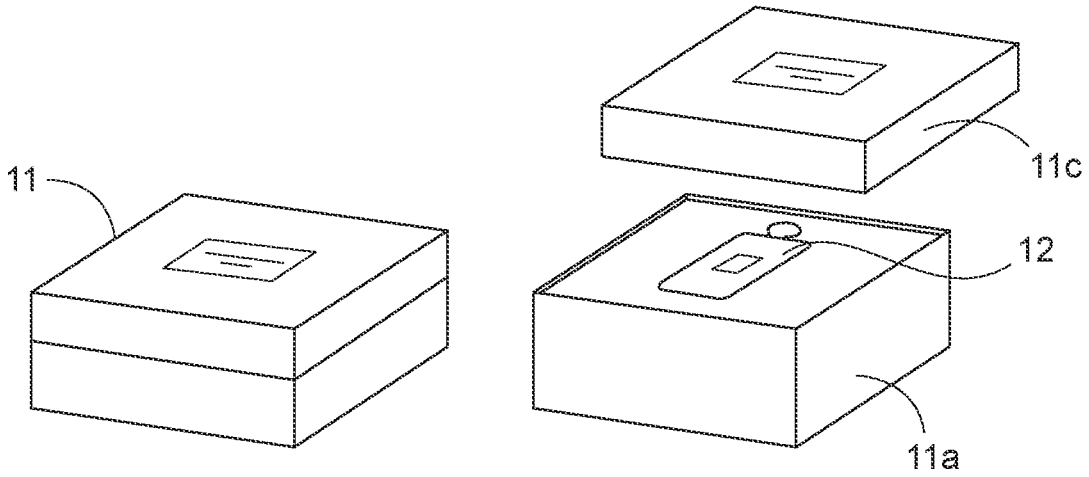
FIG. 2A depicts a second embodiment of a combination of primary and secondary packaging according to the invention.
Figure 2B:
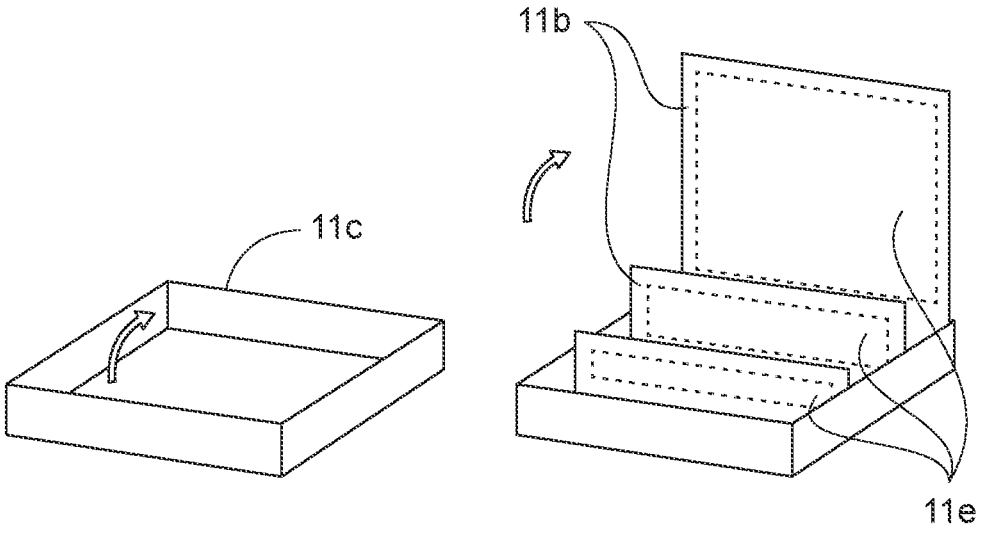
FIG. 2B depicts a portion of the secondary packaging of FIG. 2A that has been printed with a base graphic and over-printed with a hydrochromic ink.
Figure 2C:
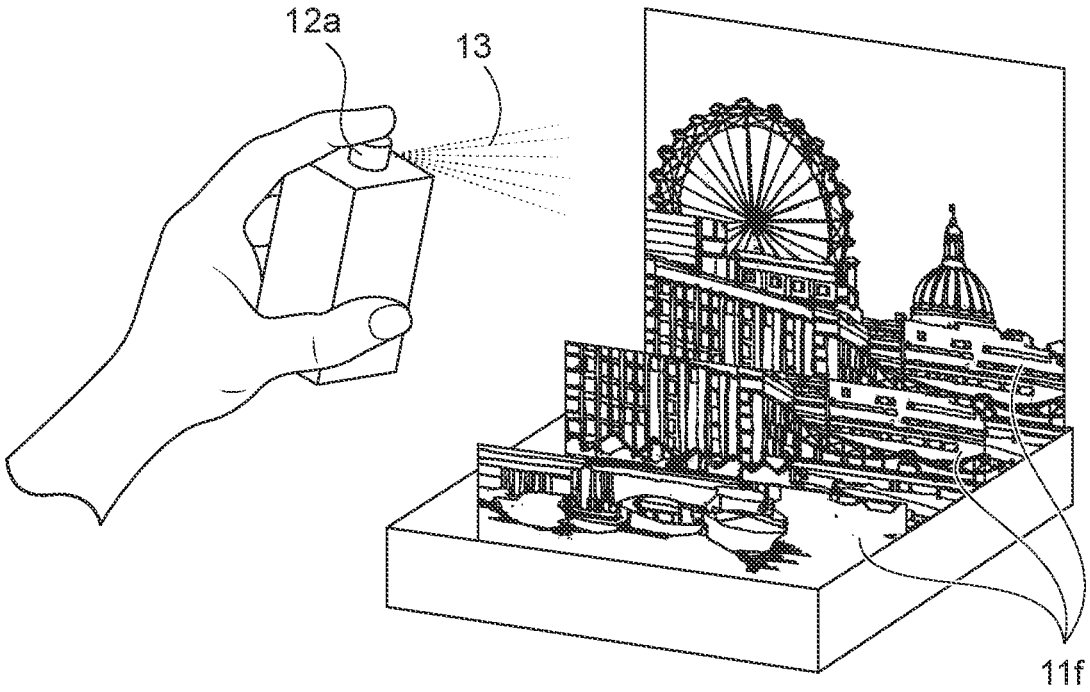
FIG. 2C depicts the secondary packaging of FIG. 2B after the surface has been sprayed with an alcohol-based liquid product that renders the hydrochromic ink transparent, to reveal the hidden graphic.

FIGS. 2A, 2B and 2C depict a second embodiment of a combination of primary and secondary packaging according to the present invention. Here again, the primary package comprises a container (12), such as a glass or plastic bottle, and a spray pump (12*a*), while the secondary package is a paper-based carton (11). The carton (11) comprises a bottom (11*a*) that has been adapted to house a container (12) of alcohol-based liquid product (13). The carton also comprises a detachable lid (11*c*). Referring to FIG. 2B, the interior of the lid may comprises one or more surfaces (11*b*) that are able to be folded from a flat position to an upright position along a living hinge, as shown. Each surface (11*b*) has been printed with a base graphic, and then over-printed, or otherwise covered, with a thin film of hydrochromic ink. In FIG. 2B, the hydrochromic ink (11*e*) is dry and therefore opaque, in this case white. The film of hydrochromic ink is indicated by the dashed lines in FIG. 2B. The container (12) is equipped with a spray pump (12*a*) for dispensing the alcohol-based liquid product (13) in the form of an aerosolized mist onto each printed surface (11*c*). This is depicted in FIG. 2C. After the printed surfaces (11*b*) have been sprayed with the alcohol-based liquid product (13), the hydrochromic film is rendered transparent, to reveal the hidden base graphics (11*f*). Thus, the printed surfaces (11*b*) provide a unique visual experience. Furthermore, the printed surfaces, as long as they remain exposed to the ambient environment, acts as an aroma diffuser, slowly, but steadily releasing perfume into the air. As the volatile perfume components evaporate from the printed surfaces (11*b*), the visual and olfactory effects diminish simultaneously. When the hydrochromic film returns to a opaque state, the aroma is also effectively gone. The process may be repeated for the life of the container of perfume.

Figure 3A:
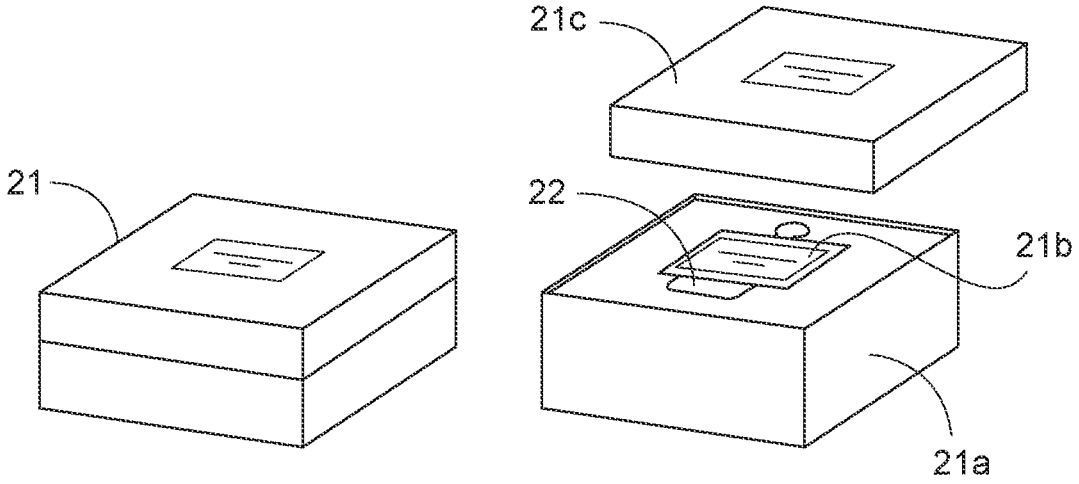
FIG. 3A depicts a third embodiment of a combination of primary and secondary packaging, wherein the secondary package includes a note card.
Figure 3B:
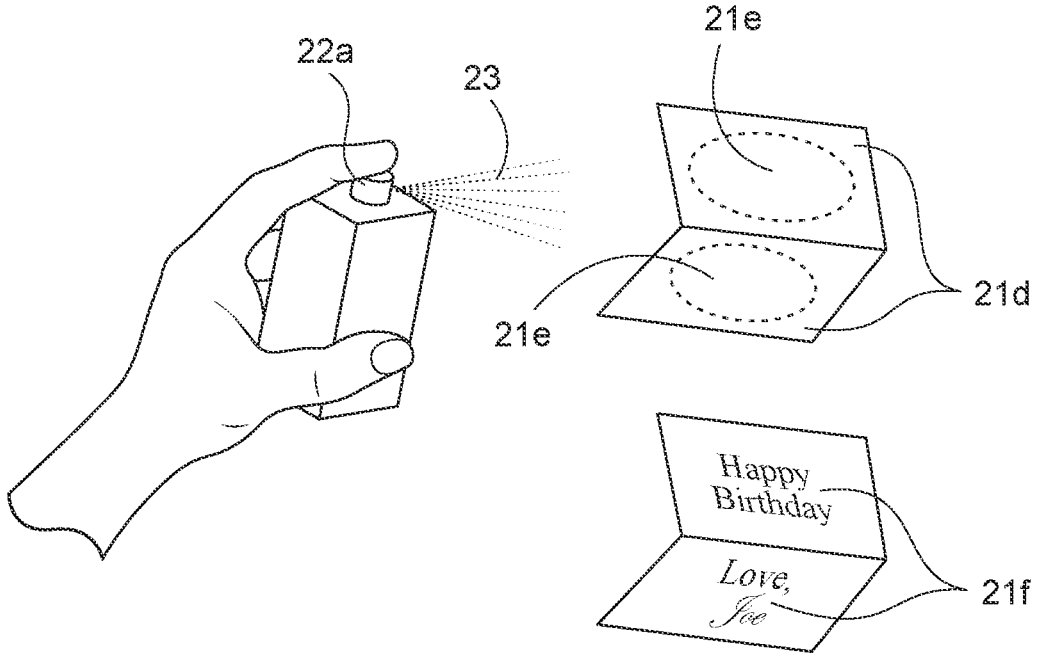
FIG. 3B depicts the note card of FIG. 3A which has a surface that has been printed with a base graphic and over-printed with a hydrochromic ink.

FIGS. 3A and 3B depict a third embodiment of a combination of primary and secondary packaging according to the present invention. Here, a paper-based carton (21) comprises a bottom (21*a*) that has been adapted to house a container (22) of alcohol-based liquid product (23). The carton also comprises a detachable lid (21*c*). Inside the carton, only accessible when the lid is removed, are one or more detached note cards (21*b*). Referring to FIG. 3B, each note card comprises one or more surfaces (21*d*) that have been printed with a base graphic, and then over-printed, or otherwise covered, with a thin film of hydrochromic ink. In the top of FIG. 3B, the hydrochromic ink (21*e*) is dry and therefore opaque, in this case white. The film of hydrochromic ink is indicated by the dashed lines in FIG. 3B. The container (22) is equipped with a spray pump (22*a*) for dispensing the alcohol-based liquid product (23) in the form of an aerosolized mist onto each printed surface (21*d*). The bottom half of FIG. 3B depicts the note card after the printed surfaces have been sprayed with the alcohol-based liquid product. The product renders the hydrochromic film transparent, to reveal the hidden base graphics (21*f*), in this case, text. Thus, the printed surfaces provide a unique visual experience. Furthermore, the printed surfaces, as long as they remain exposed to the ambient environment, acts as an aroma diffuser, slowly, but steadily releasing perfume into the air. As the volatile perfume components evaporate from the printed surfaces, the visual and olfactory effects diminish simultaneously. When the hydrochromic film returns to a opaque state, the aroma is also effectively gone. The process may be repeated for the life of the container (22) of perfume (23).

Of course, multiple surfaces of the secondary packaging could be provided with various graphic images and over-printed with hydrochromic ink.

In use, a consumer opens the secondary package, and removes the primary package (container of alcohol-based perfume product). The consumer moves any surfaces that have been printed with a base graphic and hydrochromic ink, from a first position to a second position for wetting with product. The consumer then sprays product onto the printed surfaces. Depending on the size of the printed surfaces, this my take form 1 to 10 or more doses of product.

The embodiments described herein exhibit two new uses for paper-based secondary packaging that would otherwise be immediately discarded. When sprayed with the perfume product, the secondary packaging of the present invention becomes an aroma diffuser, releasing aroma in a controlled manner, over time, and it reveals a hidden graphic. The graphic and the aroma diminish simultaneously, and the disappearance of the graphic image alerts that user that the scent in the ambient environment is no longer detectable, and the printed surfaces are ready to be sprayed with perfume. This creates interest, and increases the enjoyment of the perfume product.

What is claimed is:

1. A combination of primary and secondary packages wherein:

the primary package contains a sprayable, alcohol-based perfume, and the secondary package houses the primary package, and has one or more paper-based surfaces that bear a base graphic that has been over-printed with one or more hydrochromic inks or over-laid with a hydrochromic film.

2. The combination of claim 1 wherein the one or more paper-based surfaces has a grammage of at least 390 g/m$^2$, and is able to completely absorb a 1 mL drop of water in less than thirty seconds.

3. The combination of claim 2 wherein the one or more paper-based surfaces has a porosity of at least 8% and a minimum thickness of 0.900 mm.

4. The combination of claim 1 wherein the primary package comprises a container and a spray pump.

5. A method comprising the steps of:

providing a combination of primary and secondary packages according to claim 1;

opening the secondary package;

removing the primary package;

moving any surfaces that have been printed with a base graphic and hydrochromic ink, from a first position to a second position;

spraying product onto the printed surfaces.

* * * * *